United States Patent [19]

Malesko

[11] Patent Number: 4,492,833

[45] Date of Patent: Jan. 8, 1985

[54] DOOR JAMB SWITCH

[75] Inventor: Michael W. Malesko, Troy, Mich.

[73] Assignee: Gulf & Western Manufacturing Company, Southfield, Mich.

[21] Appl. No.: 434,523

[22] Filed: Oct. 15, 1982

[51] Int. Cl.[3] ..... H01H 3/16

[52] U.S. Cl. ..... 200/61.78; 200/61.81; 200/159 R; 200/61.76; 200/238

[58] Field of Search ..... 200/61.62, 61.76, 61.77, 200/61.78, 61.79, 61.80, 61.81, 61.82, 61.83, 61.89, 159 R, 61.7, 340, 237, 238, 275

[56] References Cited

U.S. PATENT DOCUMENTS

| | | | |
|---|---|---|---|
| 2,921,155 | 1/1960 | Basso . | |
| 3,172,981 | 3/1965 | Loesch | 200/61.76 |
| 3,249,727 | 6/1966 | Furman . | |
| 3,251,971 | 6/1966 | Fraser . | |
| 3,586,810 | 6/1971 | Brown | 200/159 R |
| 3,751,612 | 8/1973 | Hansen | 361/288 |
| 4,406,935 | 9/1983 | Montag | 200/159 R |

OTHER PUBLICATIONS

Patent Appln. Ser. No. 331,123, Date: 12/15/81 Inventor: Zulauf

*Primary Examiner*—Joseph W. Hartary
*Assistant Examiner*—Mark Reinhart
*Attorney, Agent, or Firm*—Body, Vickers & Daniels

[57] ABSTRACT

A door jamb switch has a first member adapted to be fixedly secured onto a door jamb of a motor vehicle, a first switch contact mounted on a plunger supported in the fixed first member for reciprocation along an axis between a first, door opened, position with the first switch contact engaging a second contact on the first member and a second, door closed, position with the switch contacts disengaging one another. At least one of two contacts is mounted resiliently in the switch, and the surface configurations of the two contacts can be made to interact with each other and with the resilient mounting so as to self-align the contacts with respect to one another upon interengagement therebetween.

18 Claims, 9 Drawing Figures

Figure 9:
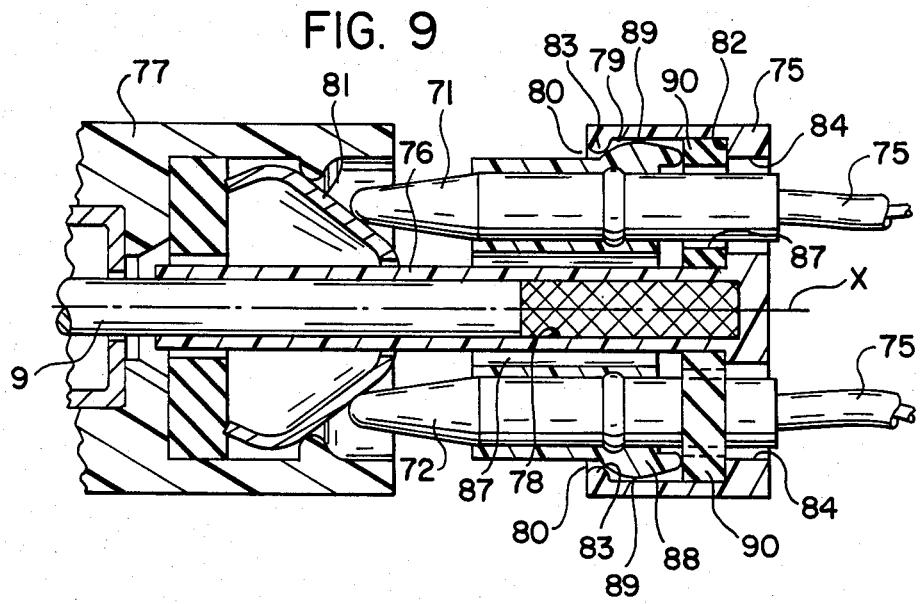

FIG. 1
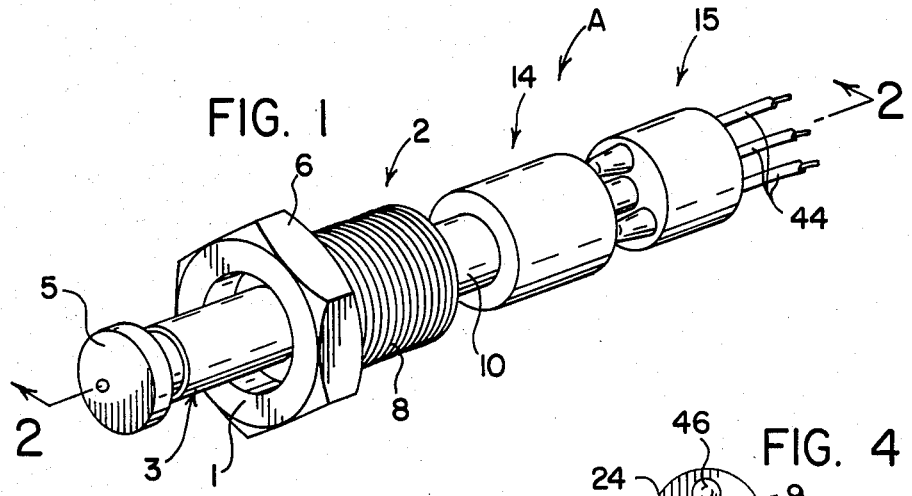
FIG. 4
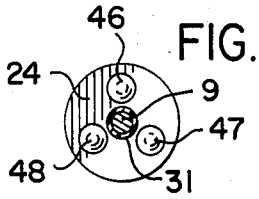
FIG. 2
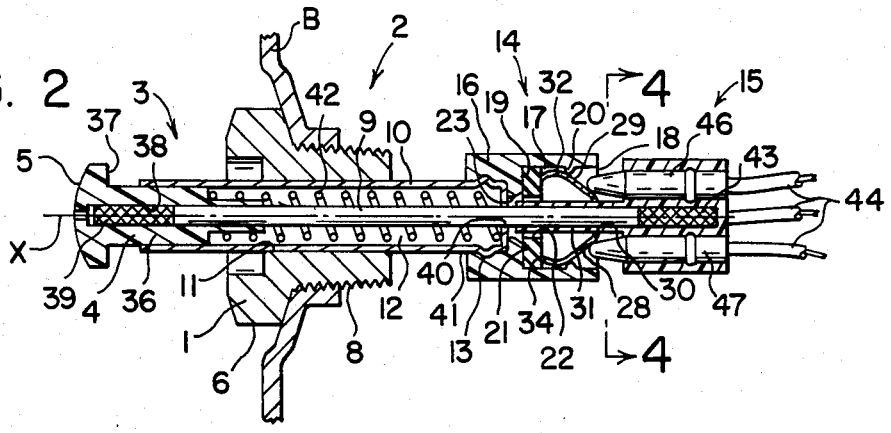
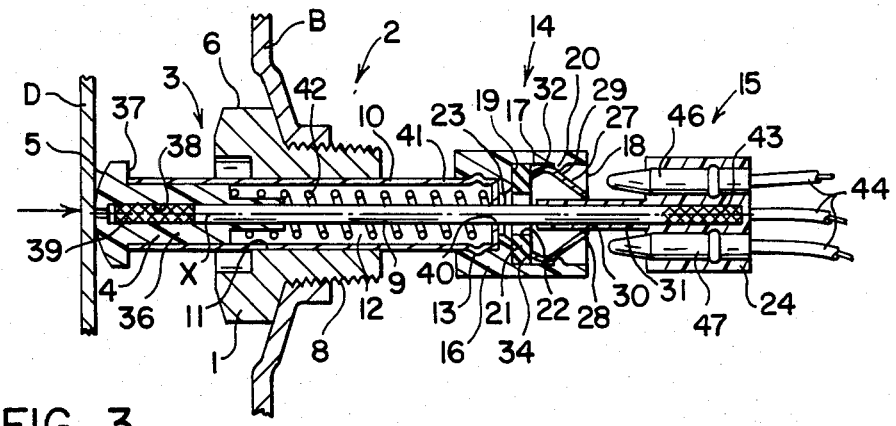
FIG. 3

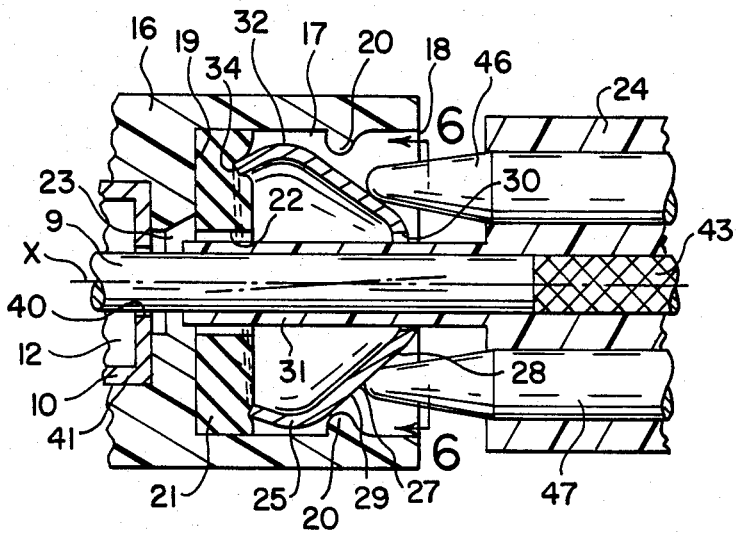
FIG. 5
FIG. 6
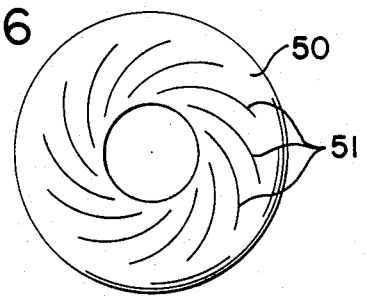
FIG. 7
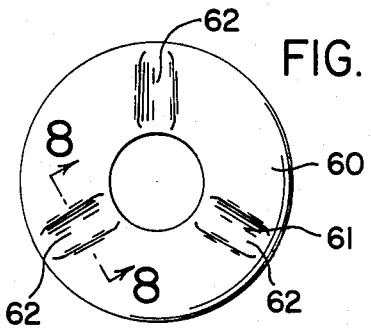
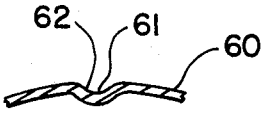
FIG. 8

DOOR JAMB SWITCH

FIELD OF THE INVENTION

The present invention relates to the art of mechanically actuated switches, and more particularly relates to an improved switch and electrical contact mounting therefore, to be used on a door jamb.

INCORPORATION BY REFERENCE

U.S. Pat. Nos. 3,249,727 and 3,251,971 are incorporated by reference herein as background information on self-adjusting door jamb switches of the general type to which the present invention is particularly applicable.

BACKGROUND OF THE INVENTION

In motor vehicles, it is common practice to employ one or more door jamb switches to activate electrical circuits in response to the opening and/or closing of a door. In general practice, these switches include an element that is shifted between a first and second condition when the vehicle door is opened and closed. A spring loaded plunger extends outwardly under spring tension when the door is opened, and is depressed when the door is closed. Due to dimensional variations in the design, manufacture and assembly of motor vehicles, the distance between the inner face of a door and its matching door jamb may be different from door to door. To compensate for this condition, self-adjusting door jamb switches as shown generally in U.S. Pat. Nos. 3,249,727 and 3,251,971 have been commonly employed by the automotive industry. Also of note is U. S. patent application Ser. No. 331,123 entitled "Improved Door Jamb Switch", filed Dec. 15, 1981, now U.S. Pat. No. 4,406,935 and assigned to the assignee of the present invention. These switches have a collapsible plunger or other arrangement which self-adjusts upon the initial closing of the door against the jamb after the switch has been installed. Thereafter, the switch operates in accordance with this initial adjustment. Generally, in these self-adjusting door jamb switches the plunger is adapted to reciprocate longitudinally in a mounting sleeve fixed onto the door jamb. The switch has a first contact assembly mounted to the sleeve, and a second contact assembly mounted to the reciprocating plunger. In the typical case, when the plunger is in its extended, door opened, position, electrical contacts on the two contact assemblies close, and when the plunger is in its depressed, door closed, position, the electrical contacts open.

Although self-adjusting door jamb switches have been known in the past, the self-adjusting aspect of the switch has been in the longitudinal adjustment of the plunger movement or extension within the sleeve. This adjustment, however, does not assure that the electrical contact surfaces of the switch are in good alignment. In the past, fairly close tolerances were required for individual parts of the switch in order to obtain good contact alignment. This added to the time and cost required to produce and inspect the individual parts and the switch assembly itself. Even then, contact alignment was not always adequate. In such cases, where contact alignment was less than optimum, the switches might fail prematurely due to wear and/or arcing due to poor surface contact. Also, as is known in the art of electrical switches, the current carrying capacity or rating of a switch can be adversely affected by poor alignment of the contact surface. Ultimately, without close tolerances on individual parts of the prior art switches, they might never function properly at all in some cases.

SUMMARY OF THE INVENTION

In accordance with the present invention then, there is provided an improvement in electrical switches by which the foregoing contact alignment problem is minimized or overcome. In the preferred embodiment the switch is of the type having a housing adapted to be fixedly secured onto a door jamb, a first electrical contact mounted on a plunger supported in the housing for reciprocation along an operating axis relative thereto and a second electrical contact which is supported on the housing to engage and disengage the first contact in response to displacement of the plunger in opposite directions between first and second actuated or operative positions by a door. In accordance with the invention, one or both of the first and second contacts are resiliently mounted with respect to either the plunger or housing respectively, so that one or both can move or "float" and self-align with the other upon interengagement. In accordance with one aspect of the invention, the resilient mounting allows axial, lateral and angular spring loaded contact movement relative to the operating axis of the plunger.

In accordance with another aspect of the invention, one or both of the contacts are mounted so as to provide rotational movement thereof with respect to the operating axis of the switch.

The "floating" contact assembly can comprise a contact block or terminal block onto which a contact is mounted. The contact can consist of the contact itself, or can comprise a contact or electrically conductive contact surface mounted onto a holder, with the holder being resiliently mounted onto the block. The "floating" electrical contact can be mounted in a cavity of the contact block, the cavity being cylindrical in cross-section with its axis being parallel to the operating axis of the switch. A resilient washer is located in the bottom of the cavity. The outward surface of the contact is contoured to have a radial dimension which increases along the operating axis of the switch in a direction toward the base of the cavity. This outer surface dimension radially increases to a ridge or enlarged portion as it approaches the bottom of the cavity and thereafter decreases as it approaches a base portion of the contact which abuts the resilient washer. The contact movably fits within said cavity, the outer diameter at the ridge or enlarged portion being less than the diameter of the cavity so as to allow free movement of the contact therein. The contact is retained in said cavity by means of an inward circumferential flange on the interior surface of the cavity, the diameter of the opening through the flange being somewhat smaller than the diameter of the contact at the ridge or enlarged portion.

In accordance with another aspect of the invention, one contact is conical in shape, having a conical contact surface, and also having spiralling flutes thereon. The second contact has multiple contact pegs wherein, when the first and second contacts are moved to the first, closed position the pegs come into surface contact with the flutes of the conical surface and cause the conical contact member to rotate.

In another aspect of the invention, the contacting surfaces of respective contacts have complimentary mating surface configurations to each other so as to increase the contact area between the surfaces.

FIGS. 7 and 8 show still another configuration for the shorting contact. FIG. 7 depicts an elevation view of a shorting contact 60 similarly as in FIG. 6, and FIG. 8 shows a cross-sectional view of the shorting contact 60 taken on the line designated 8—8 in FIG. 7. In this embodiment, the contact surface 61 of the shorting contact 60 has individual grooves 62 therein which extend in a generally straight line on the surface 61 radially outward from the operating axis X. The shape of these grooves is made to conform with and mate with individual ones of the contact pegs 46, 47 and 48 on the second terminal block 24. With this complimentary surface configuration for the shorting contact 60, there is a large actual contact surface area between the shorting contact 60 and the individual contact pegs 46, 47 and 48 of the second terminal block 24, thus increasing the current carrying capacity of the switch over a configuration having point contact between the surfaces.

In the embodiments described thus far, the shorting contact is resiliently mounted or "floating". Alternatively, the contacts corresponding to pegs 46, 47 and 48 on the second terminal block 24 can be similarly resiliently mounted or "floating", either alone or in combination with a "floating" shorting contact. FIG. 9 depicts such a configuration and with reference to FIG. 9, contacts 71, 72 and 73 corresponding to contact pegs 46, 47 and 48 described hereinbefore, are resiliently mounted in a contact block 75 similarly mounted in the switch as the contact block 24 in the embodiment depicted in FIGS. 1-5. The terminal block or contact block 75 has a protruding portion 76 which is centrally located and extending toward a shorting contact block 77, similar to the one depicted in FIGS. 2-5, along the operating axis X. The protruding portion 76 has a cavity 78 therein along the operating axis X to fixedly receive the operating shaft 9. An annular cavity 79 surrounds the protruding portion 76 and has a cylindrical radially inward surface with its axis generally parallel to and coinciding with the operating axis X of the switch A, and has an annular opening 80 at a first end of the cavity 79 facing the shorting contact 81, and an innermost base or bottom wall portion 82 at an opposite end. The cavity 79 also has a radially inward extending circumferential flange 83 on its inner surface at the opening 80. Clearance holes 84, one for each of the three contacts 71, 72 and 73, are provided through the bottom wall of the cavity 79 for wires 75 connected to the individual contacts 71, 72 or 73.

Seated against the bottom wall 82 of the cavity 79 is a resilient annular washer 90 having contact peg holes 87 therethrough, each being aligned with one of the holes 84 in the terminal block 75 for the wires 85.

The three contacts 71, 72 and 73 are molded into a common holder 88 such that they are in alignment with the corresponding holes 84 in the second terminal block 75. The outer surface of the holder 88 is generally circular in cross-section in a plane perpendicular to the operating axis X, being cylindrical in outer surface shape with its axis as assembled parallel and coinciding with the operating axis X of the switch A. The holder 88 includes a central clearance hole 87 therethrough for the shaft 9 and the protruding portion 76 of the second terminal block 75. A radially outward extending, axially convex, circumferential ridge 89 is provided on the outer surface of the holder 88. The ridge 89 is smaller in outside diameter than the inside diameter of the cavity 78, but is larger in diameter than the radially inward surface of the flange 83 so that the holder 86 can be pressed or "snapped" into the cavity of the terminal block 75 past the inward flange 83 thereof to be supported resiliently, or in a "floating" manner, therein between the flange 83 and the resilient washer 90.

In a manner similar to that described in connection with the embodiment depicted in FIGS. 2-5, when the shaft 9 is moved to its extended (door opened) actuated position, the contacts 71, 72 and 73 in the holder 88 can longitudinally, angularly and radially move upon engagement with the shorting contact 81 against the resilient washer 90 so as to provide a desired contact alignment and uniform interengaging contact force.

Although several particular embodiments and aspects of the invention have been described, many modifications readily apparent to those skilled in the art are possible. For example, although the shorting contact has been described as being made out of an electrically conductive material, only the contact area need be conductive. Further, the contact area may have discontinuities or individual contact surfaces to switch different circuits in an isolated manner. Further, while three contact pegs are preferred in the second terminal block, which are equally spaced radially and angularly about the operating axis, it will be appreciated that a fewer or greater number could be used, possibly with unequal spacing, without departing from various aspects of the invention. Still further, although in the configuration of FIG. 9 all three contact pegs are mounted in a common holder with the holder being mounted in the second terminal block, individual contacts could be separately mounted in the terminal blocks so that they can individually self-adjust.

Other modifications can be made without departing from the invention, and it is to be understood that the foregoing descriptive matter is to be interpreted only as an illustration of the invention and not as a limitation.

Having thus described my invention I claim:

1. A door jamb switch comprising:

a stationary member adapted to be fixedly secured onto a door jamb;

a plunger within said stationary member mounted for reciprocation along an operating axis by a door between a first position and a second position;

first and second support members with first and second electrical contacts respectively supported thereon, said first and second support members being mounted along said operating axis with said first support member fixed with respect to said stationary member and said second support member on said plunger and movable therewith so as to provide for relative movement of said support members with respect to each other between first and second positions in response to the reciprocation of the plunger, the first position having said contacts in biased engagement with each other and the second position having said contacts disengaged from each other; and at least one of said first and second support members including a member of resilient material separate from its respective electrical contact which member yieldingly supports said respective electrical contact for angular displacement relative to said operating axis during engagement of said contacts with each other.

2. A door jamb switch as defined in claim 1, wherein:

said support member with said member of resilient material has a cavity therein, said cavity having a cylindrical inner surface, the axis of said inner surface coinciding with the operating axis of the plunger, and an inner-most base portion at one end thereof along the operating axis;

said resilient member is located in the base portion of said cavity;

said respective contact has a base which is symmetrical about the operating axis and abuts said resilient member; and wherein the switch further comprises:

retaining means to hold said contact in the cavity in abutting relationship with the resilient member while allowing it to be moved against said resilient member angularly with respect to the operating axis.

3. A door switch as defined in claim 2, wherein:

the contact which is resiliently supported has a first and second end taken along the direction of the operating axis, and an outer surface which is generally frusto-conical in shape, with a circumferential ridge of a predetermined outer diameter; and the retaining means is a circumferential flange on said inner surface of said cavity, said flange extending inward and having a smaller inward surface diameter than the outer diameter of said circumferential ridge.

4. A door jamb switch as defined in claim 2, wherein:

said first contact has a frusto-conical shaped outer surface; and said second contact has multiple elongated contact pegs positioned to engage said frusto-conical shaped outer surface of the first contact at distributed points thereabout when the first and second contacts are in their first position.

5. A door jamb switch as defined in claim 4, wherein said frusto-conical outer surface of the first contact further includes outward spiraling flutes.

6. A door jamb switch as defined in claim 4, wherein said frusto-conical outer surface of the first contact is grooved to be a complimentary mating surface to a contact surface on the second contact.

7. A door jamb switch as defined in claim 3, wherein:

said first contact has a frusto-conical shaped outer contact surface; and said second contact has multiple elongated contact pegs positioned to engage said frusto-conical shaped outer surface at distributed points thereabout when the first and second contacts are in their first operative position.

8. A door jamb switch as defined in claim 7, wherein both contacts are resiliently mounted.

9. A door jamb switch as defined in claim 7, wherein the resiliently mounted contact is held by a contact holder mounted in said support member, said contact holder having a ridge portion thereon, which ridge portion has an outer diameter greater than the inward surface diameter of said flange on said support member.

10. An electrical switching device having an actuator adapted to be moved between first and second positions, said switching device comprising:

a first support member stationary with respect to said actuator having a first contact supported thereby, and a second support member secured to said actuator having a second contact supported thereby, said first and second support members being movable with respect to each other along an operating axis between said first position wherein said first and second contacts are in biased engagement with each other, an said second position wherein said first and second contacts are disengaged;

a member of resilient material and a contact retainer on the first support member, said contact retainer maintaining said first contact against the resilient member in movable manner allowing angular reorientation of said first contact with respect to said operating axis when said switching device is in said first position.

11. A device as defined in claim 10, wherein said first support member has a cavity therein, said cavity having a bottom portion at one end and said resilient member is in the bottom portion of said cavity with said first contact abutting said resilient member.

12. A device as defined in claim 11, wherein:

said cavity in said first support member has a cylindrical-shaped inner surface, said cylindrical-shaped surface having an axis parallel with said operating axis;

said contact retainer comprises a flange circumferentially around and extending from said cylindrical-shaped inner surface, said flange defining a cylindrical opening of a predetermined diameter;

said resilient member is annular and disposed between said bottom portion of said cavity and said flange; and said first contact has a generally cylindrical-shaped ridge thereon, said ridge having an outer diameter greater than the diameter of the opening defined by said flange, and being disposed within said cavity between said resilient member and said flange such that said contact member is held against said resilient member by contact between said cavity flange and said ridge on said contact.

13. A device as defined in claim 12, wherein said first contact has a generally frusto-conical conductive surface, said frusto-conical surface having a small diametral sloping portion and a large diametral sloping portion, the intersection of said portions defining said ridge, and said second contact has multiple electrical contact pegs for biased engagement with said first contact when said support members are in said first position and disengaged therefrom when said support members are in said second position.

14. A device defined in claim 12, wherein said second contact has a generally frusto-conical conductive surface, and said first contact has a holder member having multiple electrical contact pegs mounted thereon, said holder member having a generally cylindrical outer surface with a circumferential ridge thereon, said ridge having an outer diameter larger than the diameter of the opening defined by said cavity flange.

15. A device as defined in claim 13, wherein said second contact has three contact pegs equally spaced radially from and angularly about said operating axis.

16. A device as defined in claim 14, wherein said first contact has three contact pegs equally spaced radially from and angularly about said operating axis.

17. A device as defined in claim 13, wherein the frusto-conical conductive surface on said first contact further includes outward spiraling flutes.

18. A device as defined in claim 13, wherein the frusto-conical conductive surface on said first contact is grooved to have complimentary mating surface to corresponding contact pegs on said second contact.

* * * * *